United States Patent [19]

Ishibashi et al.

[11] Patent Number: 4,700,545

[45] Date of Patent: Oct. 20, 1987

[54] REFRIGERATING SYSTEM

[75] Inventors: Kiyoshi Ishibashi, Toyota; Yujiro Ukai, Nagoya, both of Japan

[73] Assignee: Aisin Seiki Kabushiki Kaisha, Aichi, Japan

[21] Appl. No.: 860,034

[22] Filed: May 6, 1986

[30] Foreign Application Priority Data

May 6, 1985 [JP] Japan ..... 60-95741

[51] Int. Cl.[4] ..... F25B 9/00

[52] U.S. Cl. ..... 62/6; 62/513; 62/467

[58] Field of Search ..... 62/467, 6, 513, 113; 60/520

[56] References Cited

U.S. PATENT DOCUMENTS 3,147,600 9/1964 Malaker et al. .

4,522,032 6/1985 Nakamura ..... 62/513

*Primary Examiner*—Henry Bennet

*Attorney, Agent, or Firm*—Burns, Doane, Swecker & Mathis

[57] ABSTRACT

A refrigerating system for generating low temperatures has one high-temperature region refrigerator sub-system and one low-temperature region refrigerator sub-system. The low-temperature region refrigerator sub-system has at least one expansion space defined internally of a first bellows and at least one compression space defined internally of a second bellows. Each bellows is expanded and contracted by a respective connecting member coupled to a power source. A working medium provided in the low-temperature region refrigerator sub-system travels through a flow path between the compression and expansion spaces inside the respective bellows. Means are provided for bringing the maximum pressure of the working medium to a value below its critical pressure, or for bringing the critical pressure of the working medium to a value between its maximum and minimum pressures, thereby liquifying some or all of the working medium in the at least one expansion space.

5 Claims, 6 Drawing Figures

REFRIGERATING SYSTEM

BACKGROUND OF THE INVENTION

1. Field of the Invention:

This invention relates to a refrigerating system for generating low temperatures and comprising two systems of refrigerators, one for a high-temperature region and one for a low-temperature region.

More particularly, the invention relates to a refrigerating system for absorbing heat energy at low temperatures less than the critical temperature of a working medium, and comprises, in combination, a single low-temperature region refrigerator constituted by a compression space, a cooler, a regenerator and an expansion space, or a plurality of low-temperature region refrigerators each constituted by a compression space, a cooler, a regenerator, a heat exchanger and an expansion space (e.g. a Sterling cycle refrigerator, Vuilleumier cycle refrigerator, Gifford cycle refrigerator, Gifford-McMahon cycle refrigerator, etc.), and a high-temperature region refrigerator (e.g. a Stirling cycle refrigerator, Gifford-McMahon cycle refrigerator, Solvey cycle refrigerator, Vuilleumier cycle refrigerator, Claude cycle refrigerator, etc.). The invention is utilized in, for example, a cooling system mounted on a cryostat accommodating a liquid helium-cooled superconductor magnet for reliquifying helium vapor resulting from vaporization of the liquid helium due to heat penetrating the cryostat, whereby the amount of liquid helium within the cryostat is held constant at all times.

2. Description of the Prior Art:

A refrigerating system of the type to which the present invention appertains is disclosed in the specification of U.S. Pat. No. 4,335,579 and the specification of Japanese Patent Publication No. 51-13900.

The former is illustrated in FIG. 6 and is equipped with a high-temperature region refrigerator having a crankshaft 202 rotated by a power source 201, a piston 203 slidably reciprocated by the crankshaft 202, expansion spaces 204, 205, and low-temperature portions 206, 207, and with a low-temperature region refrigerator having a crankshaft 209 rotated by a power source 208, pistons 210, 211 slidably reciprocated by the crankshaft 209, a compression space 212, an expansion space 213, a heat radiating portion 214, and a regenerator 215. The heat radiating portion 214 is thermally coupled with the low-temperature portion 207, which absorbs the compression heat of the working medium generated at the compression space 212 of the low-temperature refrigerator. The low-temperature region refrigerator has a compression cylinder 216 and an expansion cylinder 217 that are thermally coupled via the low-temperature portion 206 and a precooling plate 218 to reduce heat flowing into the compression space 212 and expansion space 213 from portions at ordinary temperature.

The invention disclosed in the specification of Japanese Patent Publication No. 51-13900 relates to a method of absorbing heat energy at low temperature, as indicated by the T-S diagram (taking helium as an example) illustrated in FIG. 2. Specifically, in a refrigerator comprising a compression space, a heat radiating portion, a heat exchange portion (e.g. a regenerator or heat exchanger) and an expansion space, the disclosed method is directed to maintaining the pressure of the working medium above a pressure approximately equal to the critical pressure (Pc in FIG. 2)) at all times, and bringing the temperature of the expansion portion below the critical temperature (Tc in FIG. 2)) of the working medium. An absorbed amount of heat $Q_E$ generated by working medium expansion work in the expansion space, and an amount of mechanical work W applied to the working medium from the outside for the purpose of obtaining this heat absorption, are expressed as areas bounded by $a_2a'_2a'_3a_3$ and $a_1a_2a_3a_4$, respectively, as shown in FIG. 2.

The prior art described above involves a number of disadvantages and difficulties which will now be set forth.

In the refrigerating system of FIG. 6, the compression cylinder 216 and expansion cylinder 217 are cooled by the low-temperature portion 206 of the high-temperature region refrigerator via the heat radiating plate 218. Nevertheless, when the temperature of the compression space 212 is at the 10K level and the temperature of the expansion space 213 is at the 4K level, by way of example, the temperature of the low-temperature portion 206 is at the 20K level and the compression space 212 and expansion space 213 are penetrated by several Watts and 0.5 Watt of heat, respectively, as typical values. Consequently, the overall efficiency of the apparatus is poor, it is necessary to apply a large input to the entirety of the low-temperature apparatus in order to obtain the same refrigeration output at the expansion space 213 of the low-temperature region refrigerator, and the apparatus is of great size and weight. The reason is that since the compression space 212 and expansion space 213 are defined in the cylinders 216, 217 by the slidably disposed pistons 211, 210, respectively, the working medium invades a gap, which is formed between the piston and respective cylinder to permit the piston to slide, so that the heat carried by the working medium from the ordinary temperature portions and the heat transmitted through the piston cannot be reduced sufficiently.

The drawback with the method described in the specification of Japanese Patent Publication No. 51-13900 is that heat energy cannot be absorbed efficiently at a low temperature which is less than the critical temperature of the working medium.

The cause of this difficulty is failure to achieve a change in the state of the working medium. Specifically, in the refrigerator comprising the compression space, heat radiating portion, heat exchange portion (e.g. regenerator or heat exchanger) and expansion space, the pressure of the working medium is maintained above a pressure approximately equal to the critical pressure at all times and, consequently, when the working medium is expanded and made to absorb heat at a temperature below the critical temperature, no change of state occurs in the working medium. The amount of work W externally applied is distorted very minutely in the low-temperature region below the vicinity of the critical temperature near the critical pressure in the T-S diagram. As a result, there is a reduction in the amount of heat $Q_E$ absorbed.

It may thus be understood that COP (achieved efficiency) ($=Q_E/W$), which represents the efficiency at which heat is absorbed, undergoes a significant reduction. Let us consider an example. For a working medium which is helium gas, a maximum pressure of 3 atm, a pressure ratio of 3, a compression portion temperature of 10K and an expansion portion temperature of 4.2K, COP will be only about 12%.

SUMMARY OF THE INVENTION

Accordingly, an object of the present invention is to provide a refrigerating system in which refrigerating efficiency is improved by reducing the intrusion of heat from ordinary temperature portions.

Another object of the present invention is to provide a refrigerating system in which the working medium is caused to change state so that heat energy may be efficiently absorbed at a low temperature below the critical temperature of the working fluid.

According to the present invention, the foregoing objects are attained by providing a refrigerating system for generating low temperatures comprising one high-temperature region refrigerator sub-system and one low-temperature region refrigerator sub-system, the former at least one compression space and at least one expansion space. The at least one compression space is defined inside a first bellows, and the at least one expansion space is defined inside a second bellows. Reciprocating means operatively associated with a power source expands and contracts the first and second bellows to volumetrically expand and volumetrically contract the compression space and expansion space. A first working medium is provided in the low-temperature region refrigerator sub-system for being compressed by the at least one compression space by volumetric contraction thereof to produce heat and expanded by the at least one expansion space by volumetric expansion thereof to effect refrigeration. A second working medium is provided in the high-temperature region refrigerator subsystem, and means are provided for thermally coupling the first working medium to the second working medium so that the heat produced by the volumetric expansion of the at least one compression space is transferred to the second working medium. Pressure regulating means is provided for bringing maximum pressure of the first working medium in the compression and expansion spaces to a value below a critical pressure of the first working medium, or for bringing the critical pressure of the first working medium to a value between maximum and minimum pressures thereof, thereby liquifying some or all of the first working medium in the at least one expansion space due to refrigeration.

Thus, according to the invention, the working medium in the compression space or expansion space is held within the corresponding bellows and, hence, is isolated from the ordinary temperature portions. This reduces the intrusion of heat, which is ascribable to the working medium, from these ordinary temperature portions. In addition, since the maximum pressure of the working medium is made less than the critical pressure thereof, or the critical pressure of the working medium is brought to a value between its maximum and minimum pressures, the working medium changes state when it is expanded and made to absorb heat.

Other features and advantages of the present invention will be apparent from the following description taken in conjunction with the accompanying drawings.

DESCRIPTION OF THE PREFERRED EMBODIMENTS

The present invention will now be described with reference to the accompanying drawings.

Figure 1:
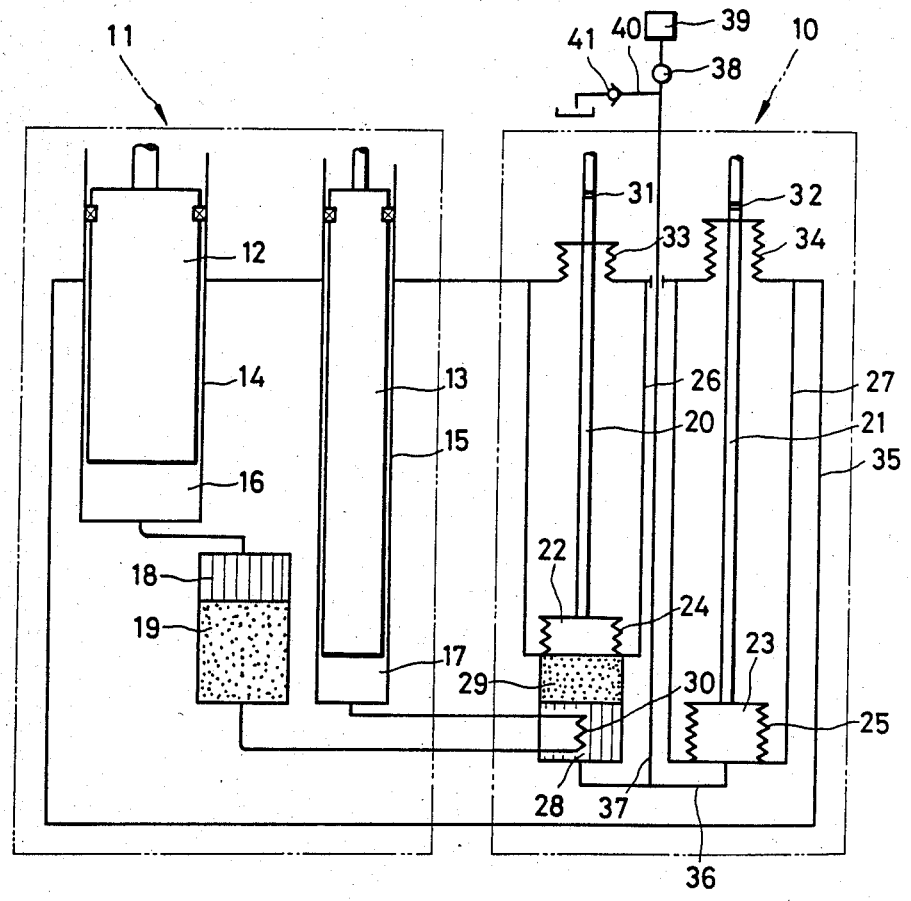
FIG. 1 is a schematic view illustrating an embodiment of a refrigerating system according to the present invention.

In a preferred embodiment of the invention illustrated in FIG. 1, a refrigerating system comprises a low-temperature region refrigerator 10 and a high-temperature region refrigerator 11. The high-temperature region refrigerator 11 includes pistons 12, 13 operatively associated with a crankshaft (not shown) coupled to a power source such as a motor (not shown), a compression space 16 defined within the cylinder 14 by the piston 12, an expansion space 17 defined within the cylinder 15 by the piston 13, a heat radiating portion 18 and a regenerator 19. The low-temperature region refrigerator 10 includes rod-shaped connecting members 20, 21 operatively associated with respective crankshafts (not shown) coupled to a power source such as a motor (not shown). Fixedly secured to the lower ends of the connecting members 20, 21 are one ends of bellows 24, 25, respectively, which internally define respective expansion and compression chambers 22, 23. The other ends of the bellows 24, 25 are secured respectively to support columns 26, 27. The connecting members 20, 21 and support columns 26, 27 are fabricated from materials having little thermal conductivity.

The expansion space 22 and compression space 23 are communicated by a heat radiating portion 28 and a regenerator 29. The heat radiating portion 28 is provided with a flow path 30 through which a low-temperature medium of the high-temperature refrigerator 11 can flow in and out. The upper ends of the connecting members 20, 21 are secured via respective bellows 33, 34 to respective connecting rods 31, 32 reciprocated by the respective crankshafts. The bellows 33, 34 have one ends thereof attached to an evacuated vessel 35.

The volumes of the expansion space 22 and compression space 23 of the low-temperature region refrigerator 10 are varied by the reciprocating motion of the respective bellows 24, 25 operatively associated with the crankshafts. By driving the system in such a manner that the expansion bellows 24 leads the compression bellows 25 by 90° in terms of the phase difference between the two volumetric variations, refrigeration will take place within the expansion space 22 and compression heat will be generated within the compression space 23. The compression heat and heat which penetrates the compression portion from the ordinary temperature portions is absorbed in the radiating portion 28 by the low-temperature working medium of the high-temperature refrigerator 11 and constitutes the refrigeration load of the high-temperature region refrigerator 11. As mentioned above, the expansion space 22 is formed by the bellows 24, one end of the bellows is operatively associated with the adiabatic connecting member 20, and the other end of the bellows is secured to the adiabatic support column 26. This eliminates the heat carried to the expansion space by the working medium present in the gap between the piston and cylinder in the conventional piston-and-cylinder type refrigerator, and reduces the heat transmitted through the piston and cylinder. Accordingly, the expansion work generated in the expansion space 22 can be extracted externally as the refrigeration output in a very efficient manner. Further, as mentioned above, the compression space 23 is formed by the bellows 25, one end of the bellows 25 is operatively associated with the adiabatic connecting member 21, and the other end of the bellows 25 is secured to the adiabatic support column 27. Thus, as set forth above with regard to the expansion space, heat intruding into the compression portion can be reduced. Accordingly, it is possible to reduce the refrigeration load of the high-temperature region refrigerator.

The volumetric change of the expansion space 22 (compression space 23) is brought about by the reciprocating motion of the adiabatic connecting member 20 (21) secured to one end of the bellows 24 (25). The connecting member 20 (21) is secured to one end of the bellows 33 (34), which is part of the ordinary temperature portion, that hermetically seals the evacuated vessel 25 with respect to the atmosphere. Secured to this end face of the bellows 33 (34) is the connecting rod 31 (33) that transmits the reciprocating motion of the drive mechanism, which also forms part of the ordinary temperature portion of the system. The reciprocating motion of the connecting rod 31 (32) is transmitted directly to the adiabatic connecting member 20 (21) via the bellows 33 (34).

A flow path 36 connecting the compression space 23 and the radiating portion 28 leads to a working medium source 39 via a flow path 37 and a valve 38. The valve 38 regulates pressure in such a manner that the maximum pressure of the working medium in the low-temperature region refrigerator 10 will be below the critical pressure thereof, or such that the critical pressure of the working medium will reside between its maximum and minimum pressures. When the working medium pressure in the flow path 37 exceeds a set pressure, the pressure is relieved through a unidirectional valve 41 provided in a flow path 40 branching from the flow path 37. Some or all of the working medium is liquified on the low-temperature side of the regenerator 29, in the expansion space 22, or both on the low-temperature side of the regenerator 29 and in the expansion space 22.

Except for the fact that the working medium in the low-temperature region refrigerator 10 is thermally coupled to the working medium in the high-temperature region refrigerator 11 via the flow path 30, the two media are entirely independent of each other and the working medium pressure in the low-temperature region refrigerator can be set independently of the comparatively high working medium pressure (e.g. 17 atm) in the high-temperature region refrigerator. An example of endothermic action for the case where the critical temperature of the working medium resides between the maximum and minimum pressures of the working medium is represented by $b_1b_2b_3b_4$ in FIG. 2.

Figure 2:
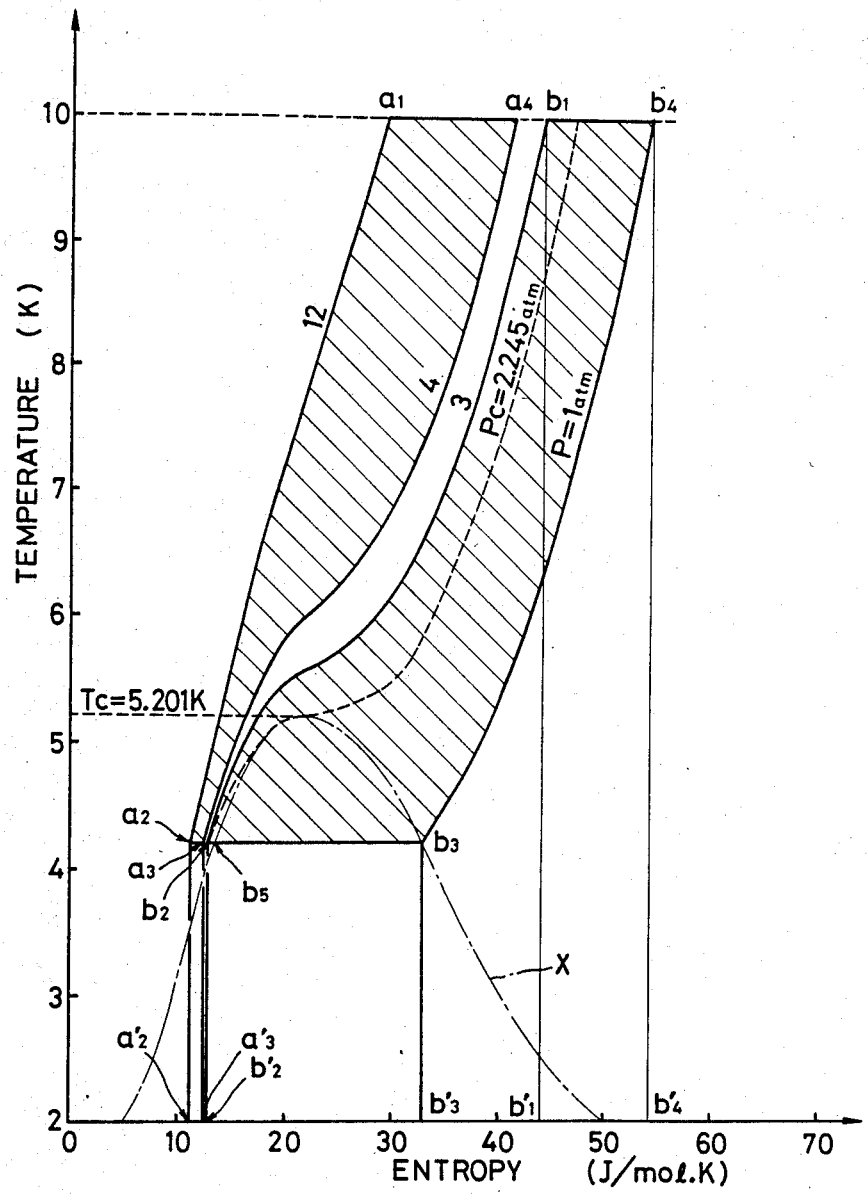
FIG. 2 is an S-T diagram in which the present invention is compared with the prior art.

The working medium which travels from the compression space 23 to the expansion space 22 through the heat radiating portion 28 and regenerator 29 at a comparatively high pressure is cooled and liquified while in transit ($b_1 \rightarrow b_2$ in FIG. 2.). When the working medium expands in the expansion space 22, the pressure thereof diminishes and some of the medium begins to gasify at point $b_5$. From the point $b_5$ where the line $b_2b_3$ is crossed by a curve X indicating the coexistence of two phases (i.e., liquid and gas), expansion and gasification of the working medium continue while pressure is held constant. All of the working medium is converted to gas at point $b_3$. In the gasification process from $b_5$ to $b_3$, the working medium absorbs the gasification heat necessary therefor. As a result, a large amount of heat absorption can be expected.

When the working medium travels to the expansion space 22 through the regenerator 29, the amount of heat Q12 (the area bounded by $b_1b_2b'_2b'_1$ given off to the regenerator 29 is greater than when the working medium travels from the expansion space 22 to the compression space 23 through the regenerator 29 (i.e. $b_3 \rightarrow b_4$). This difference in the amount of heat flows into the expansion space 22 every cycle and consumes a large portion of absorbed heat accompanying the gasification heat.

Let QE' represent substantial endotherm that takes into account an imbalance in the absorption and discharge of the heat of the working medium in the regenerator 29. Then QE' will be expressed by area $b_2b'_2b'_3b_3$ - (area $b_1b_2b'_2b'_1$ - area $b_4b_3b'_3b'_4$. Let the substantial efficiency of heat absorption be expressed by $$COP' = QE'/W$$

from the amount of externally applied work W =area $b_1b_2b_3b_4$. The following example illustrates that, under these conditions, the efficiency of the above-cited method of absorbing heat energy at low temperature described in Japanese Patent Publication No. 51-13900 is surpassed even for COP'

Specifically, in the aforementioned example where helium is the working medium, the pressure ratio is 3, the compression space temperature is 10K and the expansion space temperature is 4.2K, COP' is approximately 24% when the minimum pressure is 1 atm. Thus, efficiency is raised approximately twofold in accordance with the present invention.

Figure 3:
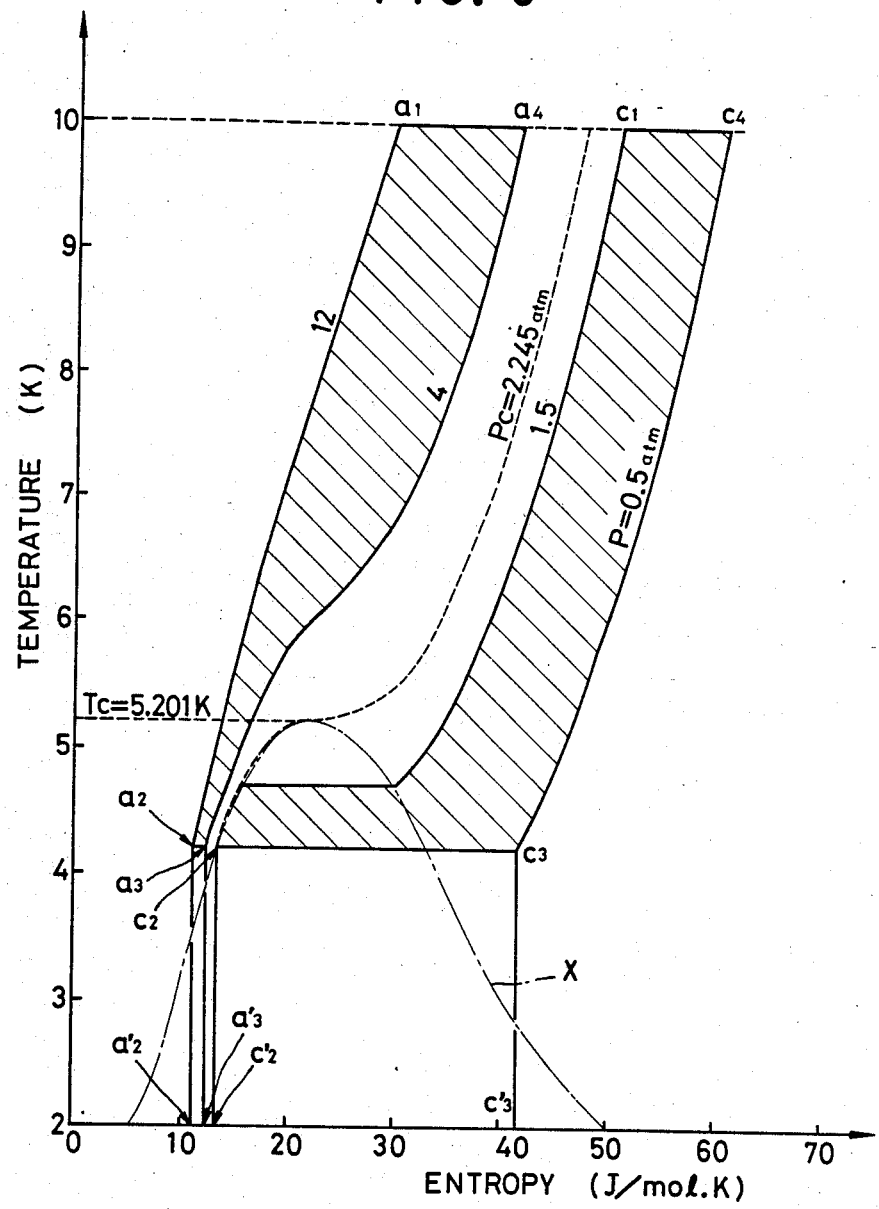
FIG. 3 is an S-T diagram similar to that of FIG. 2.

FIG. 3 shows an example for the case where the maximum pressure of the working medium is made less than its critical temperature. Where the maximum pressure of the working medium is 0.5 atm and COP' is obtained under conditions identical with those mentioned above, COP' is found to be about 40%, which represents an efficiency approximately 3.3 times higher than that obtained with the method described in the above-cited Japanese Patent Publication.

Figure 4:
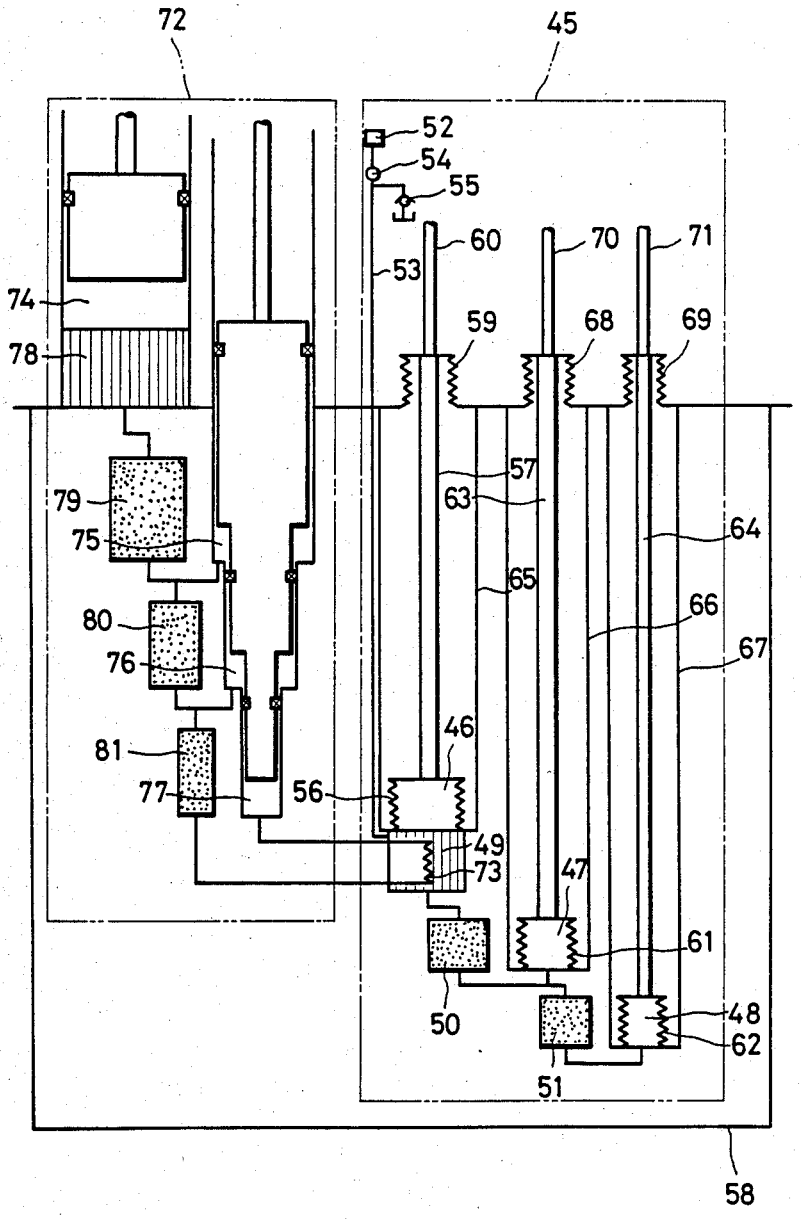
FIGS. 4 and 5 illustrate other embodiments of the present invention.

FIG. 4 illustrates another embodiment of the present invention, in which a low-temperature region refrigerator 45 is a two-stage expansion-type refrigerator having a compression space 46, a first expansion space 47 and a second expansion space 48. A heat radiating portion 49 and a first regenerator 50 are arranged between the compression space 46 and the first expansion space 47, and a second regenerator 51 is arranged between the first and second expansion spaces 47, 48. The refrigerator 45 forms a single sealed space.

The working spaces are filled with a working medium (e.g. helium) whose maximum pressure is below its critical pressure, or which has a critical pressure that resides between its maximum and minimum pressures. A valve 54 similar to the valve 38 in FIG. 1 is arranged in a flow passage 53 connecting the heat radiating portion 49 and a working medium source 52. A flow path branching from the flow path 53 is provided with a unidirectional valve for relieving pressure.

The compression space 46 is constituted by a bellows 56 having one end thereof operatively associated with an adiabatic connecting rod 57 and its other end secured to an adiabatic support column 65. The adiabatic connecting rod 57 is secured to one end of a bellows 59, which is part of the ordinary temperature portion, that hermetically seals an evacuated vessel 58 with respect to the atmosphere. Secured to this end face of the bellows 59 is a connecting rod 60 that transmits the reciprocating motion of the drive mechanism, which also forms part of the ordinary temperature portion of the system, just as in the embodiment of FIG. 1. The first expansion space 47 and second expansion space 48 are of the same construction as the compression space 46 and are similarly associated with respective bellows 61, 62, adiabatic connecting rods 63, 64, adiabatic support columns 66, 67, bellows 68, 69 for air-tight vacuum, and connecting rods 70, 71. The heat radiating portion 49 is provided with a flow path 73 through the low-temperature working gas in a high-temperature region refrigerator 72 can flow in and out. This serves to remove compression heat, which is generated in the compression space 46, as the refrigeration load of the high-temperature region refrigerator 72.

The high-temperature region refrigerator 72 is a three-stage expansion-type refrigerator and has a heat radiating portion 78 and a first regenerator 79 arranged between a compression space 74 and a first expansion space 75, a second regenerator 80 arranged between the first expansion space 75 and a second expansion space 76, and a third regenerator 81 arranged between the second expansion space 76 and a third expansion space 77. The third regenerator 81 and the third expansion space 77 are communicated by a working gas flow path 73.

In operation, power from the drive mechanism of refrigerator 45 is transmitted through the connecting rods 70, 71 and adiabatic connecting rods 63, 64 to position the bellows 61, 62 at top dead center. At the same time, power from the drive mechanism is transmitted through the connecting rod 60 and adiabatic connecting rod 57 to move the compression space bellows 56 from bottom dead center toward top dead center, at which time the working medium filling the compression space 46 is compressed.

Next, the compression space bellows 61, 62 are moved toward bottom dead center while the compression space bellows 56 is moved further toward top dead center, whereby the working medium in the compression space 46 is moved into the expansion spaces 47, 48. During this fluidic motion, compression heat is given off, at the radiating portion 49, to the comparatively high-pressure working medium of the high-temperature region refrigerator flowing through the flow path 73, and heat energy is also given off to the regenerators 50, 51, whereby the working medium from the bellows 56 has its temperature reduced to below the critical temperature. Thus, some or all of this working medium is liquified on the expansion side of the regenerator 51, or in the expansion space, or in both the regenerator and expansion space.

After the compression bellows 56 reaches top dead center to move all of the working medium from the compression space 46 to the expansion spaces 47, 48, the compression bellows 61, 62 are moved toward bottom dead center, whereupon the working medium liquified in the expansion space 48 begins to be gasified and heat is absorbed as gasification heat from the external heat source of the expansion bellows 62.

If all of the working medium is gasified before the compresssion bellows 62 reaches bottom dead center, the working medium does expansion work, and continues to absorb heat, from this time until the expansion bellows 62 reaches bottom dead center.

When the expansion bellows 61, 62 begin to move toward top dead center and, at the same time, the compression bellows 56 begins to move toward bottom dead center, the working medium which has expanded and absorbed heat in the expansion spaces 47, 48 travels from the expansion space 47 to the compression space 46 through the regenerator 50 and from the expansion space 48 to the compression space 46 through the regenerator 51 and then the regenerator 50. At this time, the working medium absorbs heat energy in the regenerators 50, 51. When the working medium returns to the compression space 46, its temperature will have been raised to that which prevailed within the compression space 46 at the beginning of the cycle.

When the expansion bellows 61, 62 reach top dead center and, at the same time, the compression bellows 56 reaches bottom dead center, the cycle is completed and the operation described hereinabove is repeated.

Figure 5:
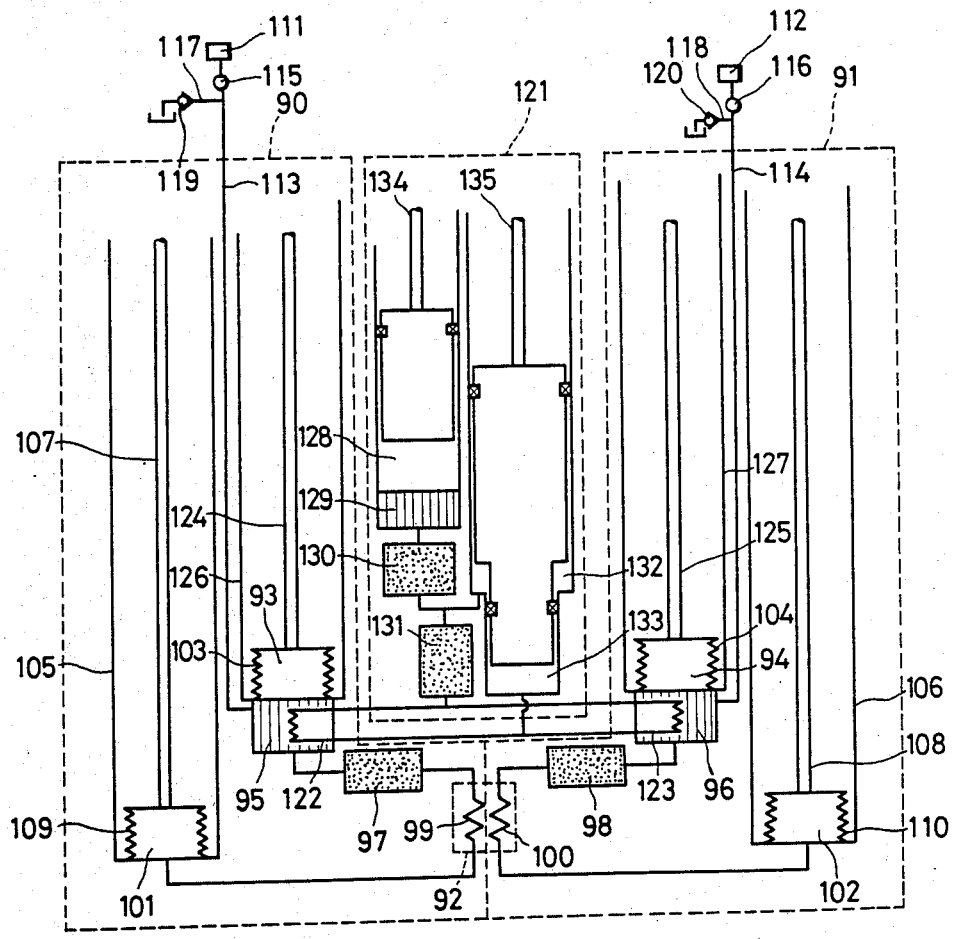
Figure 6:
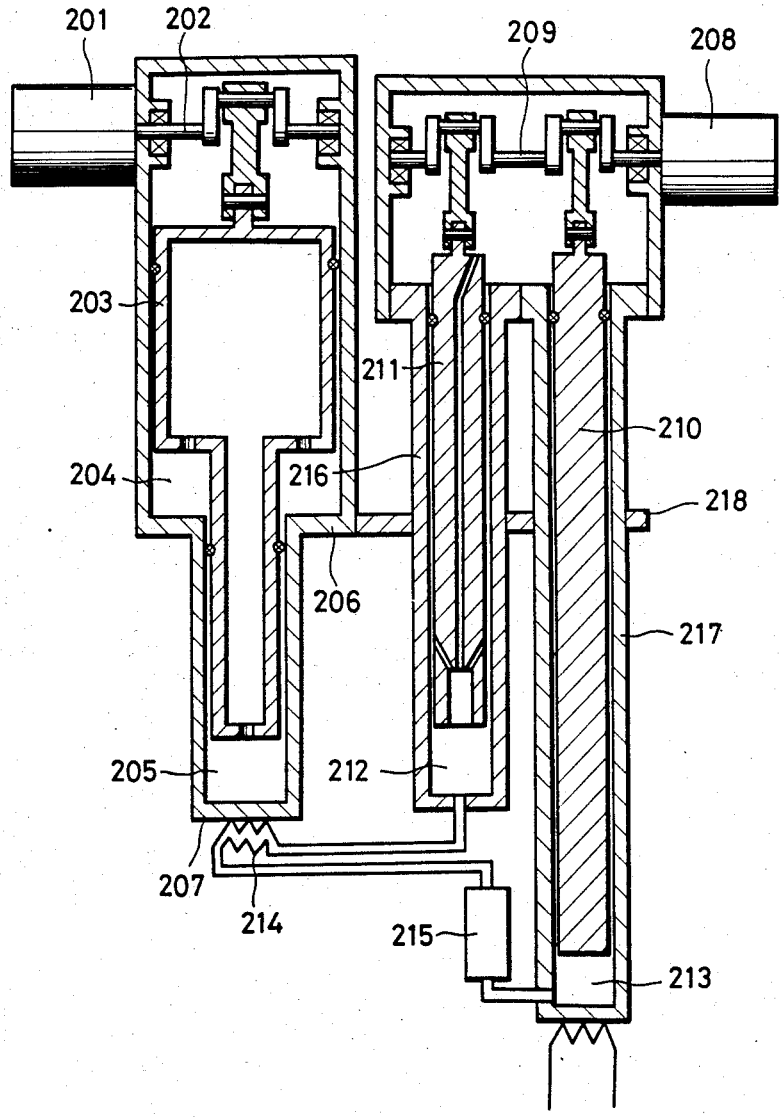
FIG. 6 PRIOR ART
FIG. 6 is a view illustrating a refrigerating system according to the prior art.

A third embodiment of the present invention is illustrated in FIG. 5.

In FIG. 5, the system includes two low-temperature region refrigerators 90, 91 thermally coupled to a heat exchanger 92. The refrigerators 90, 91 are of the same construction and respectively comprise compression spaces 93, 94, heat radiating portions 95, 96, regenerators 97, 98, heat exchangers 99, 100, and expansion spaces 101, 102. In each refrigerator, the foregoing elements are connected by piping. The compression space 93 (94) is constituted by a bellows 103 (104), one end of which is fixed by an adiabatic support column 126 (127). A volumetric change is produced in the bellows 103 (104) by reciprocating motion of an adiabatic connecting rod 124 (125). The expansion space 101 (102) likewise is constituted by a bellows 109 (110), one end of which is fixed by an adiabatic support column 105 (106). A volumetric change is produced in the bellows 109 (110) by reciprocating motion of an adiabatic connecting rod 107 (108).

The working media of the refrigerators 90, 91 are approximately equal in pressure. These pressures are set in such a manner that the maximum pressures are below the respective critical pressures of the working media, or such that the critical pressures of these media reside between the respective maximum and minimum pressures thereof. Just as in the above-described embodiments, therefore, a valve device 115 (116) is arranged in a flow path 113 (114) connecting the heat radiating portion 95 (96) and a working medium source 111 (112), and a unidirectional valve 119 (120) for relief purposes is arranged in a pipe 117 (118) branching from the flow path 113 (114). The refrigerators 90, 91, which are of so-called "counterflow" type, operate at a phase difference of 180°. Specifically, the working media flow through the respective flow paths 99, 100 inside the heat exchanger 92 in mutually opposing phases so that heat is exchanged between them. Compression heat generated within the compression spaces 93, 94 of the respective refrigerators 90, 91 is transferred at the respective heat radiating portions 95, 96 to a comparatively high-pressure (about 15 atm) working medium of a high-temperature region refrigerator 121 flowing through flow paths 122, 123. The compression heat constitutes the refrigeration load of the high-temperature region refrigerator 121.

As in the foregoing embodiments, the high-temperature region refrigerator 121 has a compression space 128, a heat radiating potion 129, regenerators 130, 131, expansion spaces 132, 133, and adiabatic connecting rods 134, 135. As in the foregoing embodiments, the adiabatic connecting rods 134, 135 are driven by the respective drive mechanisms to reciprocate, i.e. expand and contract, the corresponding bellows, not shown.

The invention has a number of outstanding advantages. Specifically, since the working medium in the low-temperature region refrigerator is completely isolated from the outside by the bellows, oil used in the drive mechanism and contaminants such as particles resulting from wear of seals in the sliding portions cannot mix with the working medium, as occurs in the piston-and-cylinder type refrigerator. This prevents a deterioration in the performance of the refrigerator caused by contamination of the regenerating materials and contamination of the flow path surfaces in the heat radiating portions.

Further, as mentioned above, the arrangement of the present invention is such that the maximum pressure of the working medium is below the critical pressure thereof, or such that the critical pressure of the working medium is between its maximum and minimum pressures. Accordingly, the pressure of the working medium is reduced, thus prolonging the service life of the bellows.

As many apparently widely different embodiments of the present invention can be made without departing from the spirit and scope thereof, it is to be understood that the invention is not limited to the specific embodiments thereof except as defined in the appended claims.

What is claimed is:

1. A refrigerating system for generating low temperatures, comprising:

one high-temperature region refrigerator sub-system and one low-temperature region refrigerator subsystem;

said low-temperature region refrigerator sub-system having at least one compression space and at least one expansion space;

said at least one compression space being defined inside a first bellows;

said at least one expansion space being defined inside a second bellows;

reciprocating means operatively associated with a power source for expanding and contracting said first and second bellows to volumetrically expand and volumetrically contract said compression space and said expansion space;

a first working medium provided in said low-temperature region refrigerator sub-system for being compressed by said at least one compression space by volumetric contraction thereof to produce heat and expanded by said at least one expansion space by volumetric expansion thereof to effect refrigeration;

a second working medium provided in said high-temperature region refrigerator subsystem;

means for thermally coupling said first working medium to said second working medium so that the heat produced by the volumetric expansion of said at least one compression space is transferred to said second working medium;

and pressure regulating means for adjusting a maximum pressure of said first working medium in said compression and expansion spaces relative to a critical pressure of said first working medium to cause liquefication of at least some of said first working medium in said at least one expansion space due to refrigeration.

2. The refrigerating system according to claim 1, wherein said reciprocating means comprises first and second connecting members each having first ends operatively associated with the power source and second ends fixedly secured to one ends of said first and second bellows, respectively, said first and second bellows having second ends fixedly secured to respective support columns.

3. The refrigerating system according to claim 2, wherein said first and second connecting members and said support columns are made of thermally insulating material.

4. The refrigerating system according to claim 1, wherein said means for thermally coupling said first working medium comprises:

heat radiating means for receiving said first working medium heated in said at least one compression space and for giving off the heat from said first working medium, and flow path means through which said second working medium flows in from said high-temperature region refrigerator subsystem and out to said high-temperature region refrigerator sub-system interiorly of said heat reading means for receiving the heat given off by said first working medium.

5. The refrigerating system according to claim 1, wherein said pressure regulating means comprises:

a working medium source for supplying said first working medium;

flow path means communicating said at least one compression space and said at least one to said working medium source;

and valve means arranged in said flow path means for regulating the pressure of said first working medium.

* * * * *